United States Patent [19]

Taylor et al.

[11] Patent Number: 4,830,300

[45] Date of Patent: May 16, 1989

[54] APPARATUS FOR REELING FLEXIBLE CABLE

[75] Inventors: James M. Taylor, Plano; Richard McComack, Jr., Trenton, both of Tex.

[73] Assignee: Atlantic Richfield Company, Los Angeles, Calif.

[21] Appl. No.: 124,697

[22] Filed: Nov. 24, 1987

[51] Int. Cl.[4] ..... B65H 75/00; B66D 5/08

[52] U.S. Cl. ..... 242/54 R; 254/378

[58] Field of Search ..... 242/54 R, 85, 86.5 R, 242/86.7; 254/359, 368, 379, 378; 188/70 R, 74

[56] References Cited

U.S. PATENT DOCUMENTS

| | | | |
|---|---|---|---|
| 506,504 | 10/1893 | Hollis | 188/74 |
| 2,225,180 | 12/1940 | Olesen | 242/54 R |
| 2,650,771 | 9/1953 | Marion | 242/54 R |
| 3,322,398 | 5/1967 | Smith | 254/378 X |
| 3,653,606 | 4/1972 | Sheets, Jr. | 254/359 X |
| 4,588,167 | 5/1986 | Finzel | 254/378 X |

*Primary Examiner*—Stuart S. Levy
*Assistant Examiner*—Steven M. DuBois
*Attorney, Agent, or Firm*—Michael E. Martin

[57] ABSTRACT

A cable reeling apparatus particularly useful for reeling and dereeling cable for seismic signal recording operations includes a lightweight frame on which a propulsion unit and drive shaft for a cable spool are supported. The cable spool is permanently mounted on the shaft and includes a removable side flange so that coils of cable may be mounted on and demounted from the spool. The spool hub and flanges are provided with cooperating grooves for receiving flexible strapping wherein the coil of cable may be bound at circumferentially spaced points before removal from the spool and field operations may be carried out without dedicated spools for each cable coil.

1 Claim, 2 Drawing Sheets

APPARATUS FOR REELING FLEXIBLE CABLE

BACKGROUND OF THE INVENTION

1. Field of the Invention

The present invention pertains to a portable power operated cable reeling and dereeling apparatus, particularly adapted for use in conducting seismic surveys.

2. Background

In conducting seismic surveys one technique involves arranging an array of geophones connected to signal transmission cables over an area wherein seismic signals are to be generated. In many instances, seismic surveys are carried out in remote and relatively inaccessible terrain making the transportation of and deploying of equipment over the area to be surveyed difficult. In this regard, there has been a need to provide improved means for handling the elongated cable assemblies used for collecting seismic data. For example, in transporting the relatively substantial lengths of cable to and from the survey site it is conventional to provide the cable in coils or reeled spools. However, the added weight of the spool structure itself only adds to the difficulty in handling and moving the cable to and from the survey site. Moreover, the relatively great lengths of cables used in seismic surveys also makes desirable the use of powered cable reeling and dereeling equipment.

In this regard, there has been a strongly felt need for improvements in seismic cable reeling and dereeling apparatus which provides an apparatus which is adapted to be relatively portable and easy to operate, and also, rather importantly, eliminates the need for providing the coiled length of cable on individual spool structures. The present invention meets at least several of the needs for improvements in cable reeling and dereeling apparatus, particularly adapted for use with seismic survey equipment but which is also useful for other cable reeling and dereeling operations.

SUMMARY OF THE INVENTION

The present invention provides an improved motor driven reeling and dereeling apparatus particularly adapted for handling seismic survey cable and the like. In accordance with one important aspect of the present invention, a skid mounted motor driven cable reeling and dereeling apparatus is provided which includes a motor driven cable reel or spool which is adapted to provide for mounting and demounting coiled lengths of seismic signal transmitting cable and the like wherein the coiled lengths of cable are not each required to utilize a dedicated spool when being transported to and from the survey site. An apparatus is provided which includes a spool having a demountable flange and an arrangement of slots in the spool flanges and hub so that coiled lengths of cable may be bound or tied by flexible cable ties and maintained in a coiled condition. The coiled cables may be mounted and demounted with respect to the cable reel to facilitate storage and handling of the cable in a coiled condition without requiring that the cable be stored on a dedicated spool.

In accordance with other aspects of the present invention, an improved portable cable reeling and dereeling apparatus is provided which includes a unique arrangement of control levers for driving a cable reel or spool and for imparting a braking action to the cable reel so that a controlled winding or unwinding operation may be carried out with relative ease. The apparatus of the present invention is particularly adapted for movement over relatively rough or inaccessible terrain and for ease of operation and handling by a work crew.

The above-noted features and advantages of the present invention together with other superior aspects thereof will be further appreciated by those skilled in the art upon reading the detailed description which follows in conjunction with the drawing.

DESCRIPTION OF A PREFERRED EMBODIMENT

Figure 1:
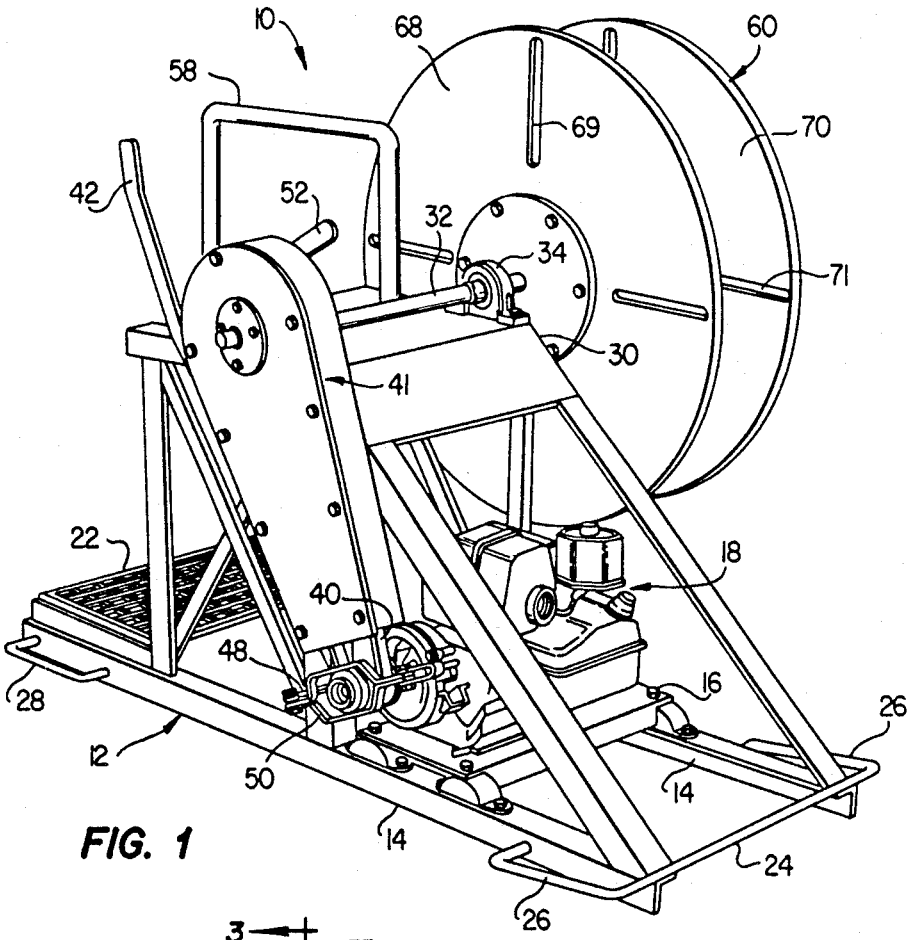
FIG. 1 is a perspective view of an improved cable reeling apparatus in accordance with the present invention.

In the description which follows like parts are marked throughout the specification and drawing with the same reference numerals, respectively. The drawing figures are not necessarily to scale and conventional features are not described in detail in the interest of clarity and conciseness.

Figure 2:
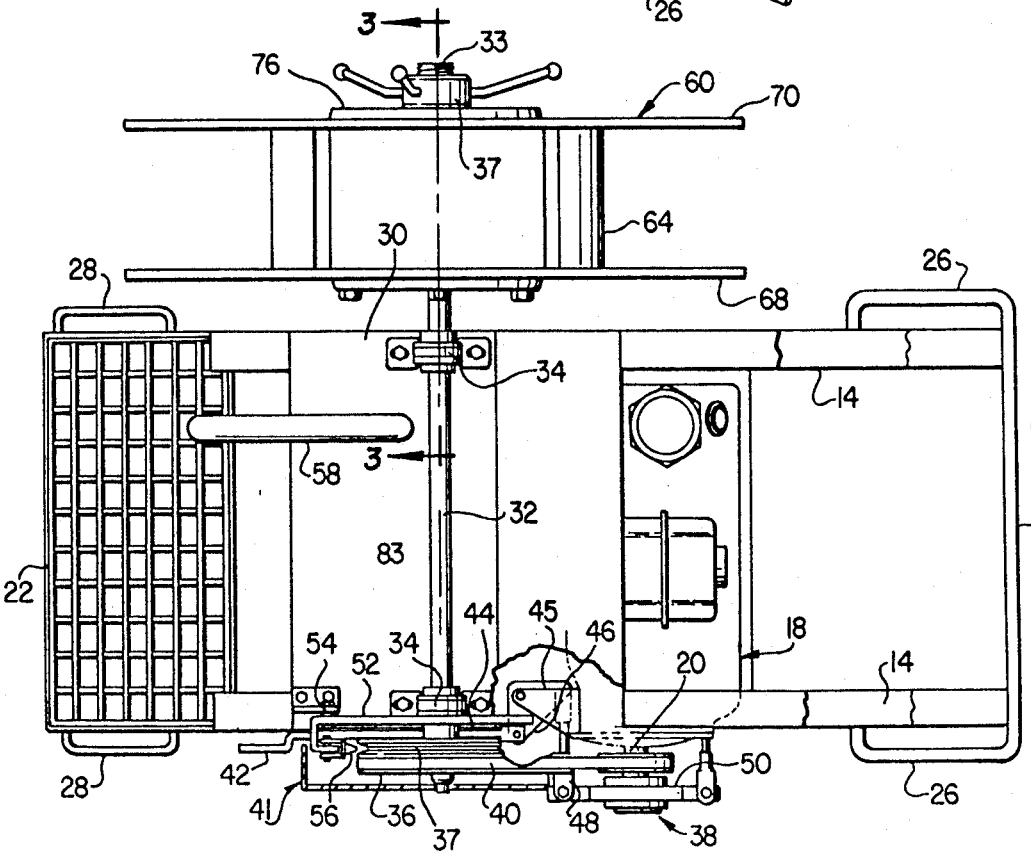
FIG. 2 is a plan view of the apparatus illustrated in FIG. 1.

Referring to FIGS. 1 and 2, the cable reeling and handling apparatus of the present invention is illustrated and generally designated by the numeral 10. The apparatus 10 includes a frame 12 characterized by spaced apart, elongated opposed frame rails 14 which are interconnected by a support pad 16 for a motor comprising a self contained internal combustion engine 18 having an output or power takeoff shaft 20, FIG. 2. An expanded metal deck 22 is disposed at one end of the frame 12 and interconnects the frame rails 14, and an integral tie rod and opposed carrying handle member 24 is suitably secured to the frame rails at the opposite end of the frame. The tie rod 24 also forms opposed carrying handles 26. Opposed carrying handles 28 are secured to the opposed frame rails 14, respectively, at the opposite frame end.

The frame 12 includes a pedestal 30 for supporting a shaft 32 for rotation thereon and disposed in spaced apart pillow block type bearings 34. As shown in FIG. 2, one end of the shaft 32 supports a double grooved sheave 36 which is disposed on and suitably keyed for rotation with the shaft. A sliding sheave-type V-belt clutch 38 is mounted on the engine output shaft 20 and is operable to impart driving motion to a flexible endless belt 40 which is trained over one of the grooves of the sheave 36. A belt guard 41 is disposed over the belt 40 and suitably secured to the pedestal 30 by means not shown. The clutch 38 is of a type commercially available such as a series 6259K available from McMaster Carr Company, Chicago, Ill. The clutch 38 is adapted to be operated by an operating lever 42 for driving engagement or disengagement of the belt 40 with respect to the shaft 20.

The lever 42 is suitably mounted for pivotal movement with respect to the pedestal 30 about a pivot 44, FIG. 2, and is connected to a bell crank member 46. The bell crank 46 is pivotally mounted on a bracket 45 and is also connected to a link 48 which is suitably connected to a clutch operating yoke 50 as illustrated in FIG. 2. The lever 42 is also conveniently disposed adjacent to a brake lever 52, which is also mounted for pivotal movement on the pedestal 30 about a pivot 54, FIG. 2. The brake lever 52 includes a brake shoe member 56 which is adapted to be engaged with the sheave 36 in a groove 37, as also shown in FIG. 2, for selectively applying braking action to the shaft 32 to control rotation thereof. Accordingly, an operator of the apparatus 10 may stand on the deck 22, facing the pedestal 30, and operate the clutch lever 42 with one hand and the brake lever 52 with the other hand for convenient control of rotation of the shaft 32 by selective engagement of the clutch 38 to drive the belt 40 and selective engagement of the brake shoe 56 with the sheave 36. A suitable guard and handhold 58 member is also provided on the apparatus as illustrated in drawing FIGS. 1 and 2.

Figure 3:
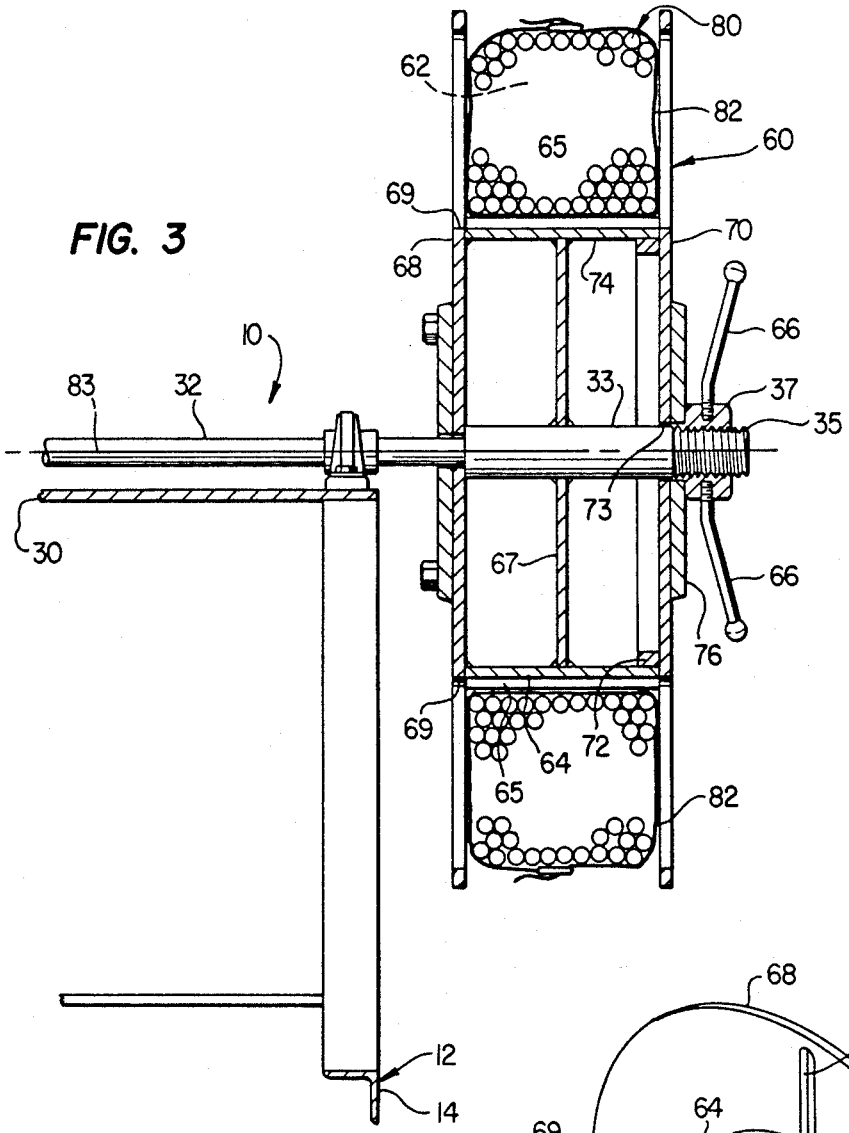
FIG. 3 is a detail section view taken along the line 3—3 of FIG. 2.

Referring further to FIGS. 1 and 2, and also to FIG. 3, the shaft 32 is adapted to support a rotatable reel or spool 60 for rotation with the shaft to reel and dereel an elongated cable 62, FIG. 3. The spool 60 includes a hub 64 having a web portion 67 suitably secured to an end part 33 of the shaft 32. The shaft end part 33 includes a threaded distal end defined by machine threads 35 on which a nut 37 may be threaded. The nut 37 includes radially extending handle members 66 for ease of threading and unthreading the nut with respect to the shaft end part 33. The spool 60 also includes opposed flange parts 68 and 70. The flange 68 may be integrally formed with the hub 64 or secured thereto. The flange 70 includes a pilot hub portion 72 which is received in a bore 74 of the hub 64. The flange 70 is adapted to be removed from the hub 64 upon unthreading the nut 37 from the shaft end part 33 and removing a spacer plate 76 which is normally interposed between the flange 70 and the nut.

Figure 4:
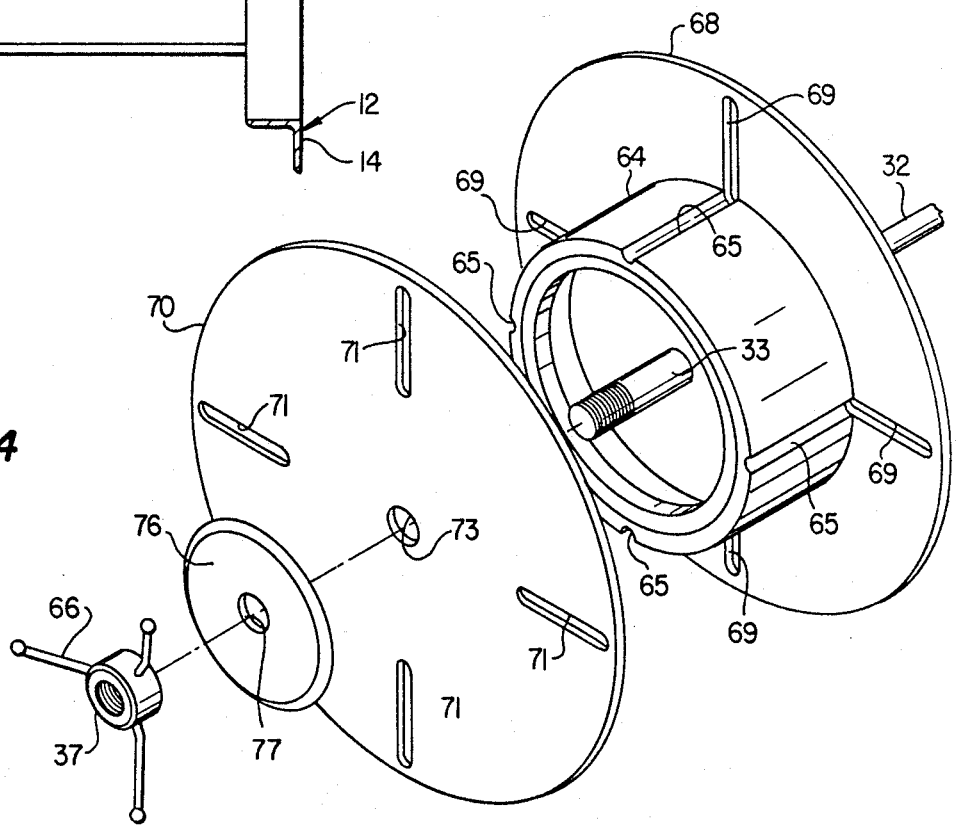
FIG. 4 is an exploded perspective view of a cable reeling and dereeling spool of the apparatus.

Referring also to FIG. 4, the hub 64 includes circumferentially spaced apart grooves 65 formed therein and extending generally parallel to the longitudinal central axis of the shaft 32. The grooves 65 extend across the peripheral surface of the hub 64 and are aligned with cooperating radially extending grooves 69 formed in the flange 68. The flange 70 also has a plurality of radially extending grooves 71 formed therein and alignable with the grooves 65 when the flange 70 is assembled to form part of the spool 60. The flange 70 also, of course, has a central opening 73 for receiving the end part 33 of the shaft 32.

As shown in FIG. 3, when a coil 80 of flexible cable 62 has been reeled onto the spool 60, flexible tie means such as strapping 82 may be threaded through the respective sets of grooves 65, 69 and 71 and suitably tied to bind the coil 80 at circumferentially spaced apart points. When a cable bundle has been bound by the strapping 82, the nut 37 may be unthreaded from the shaft end part 33 and the retainer plate 76 and flange 70 removed from the spool 60. The coil 80 may then be removed from the spool and the spool reassembled by replacing the flange 70, retainer plate 76 and nut 37 in preparation for reeling a new length of cable onto the spool. In this way, rolled bundles or coils of cable 62 may be prepared for storage and transportation without requiring a dedicated spool for each length of cable. In like manner, the spool 60 may be used for dereeling the cable by substantially reversing the order of events described herein for reeling the cable 62 onto the spool 60. Typically, a cable coil 80 is manually dereeled by disengaging the clutch 38 and controllably releasing the brake 56 from engagement with the sheave 36 so that the shaft 32 may be rotated.

In operation of the apparatus 10 to reel a length of cable 62 onto the spool 60, the cable would be wrapped around the hub 64 one or two turns to secure the cable to the spool and the motor 18 operated by an operator standing on the platform 22 and manually working the levers 42 and 52 to precisely control reeling of the cable onto the spool. After a substantial quantity of cable was reeled onto the spool such that the cable had essentially filled the groove formed between the flanges 68 and 70 and the hub 64 the strapping 82 would be threaded through the respective sets of grooves in the hub and the flanges to bind the coil 80 in preparation for removal of from the spool.

During dereeling of a coil of cable from the spool 60 the brake 56 may require operation to control the rotational speed of the shaft 32 and the spool 60 to prevent the cable from overrunning itself during payout. Alternatively, the cable coils 80 may be mounted on a spool, not shown, similar to the spool 60 but adapted to be supported for free rotation to pay out the cable 62 from a vehicle traversing the terrain on which the cable is layed. The alternative dereeling spool could be mounted in a cantilever manner as shown for the spool 60 or on a shaft between spaced apart bearing supports.

Other aspects of operating the apparatus 10 are believed to be clear to those skilled in the art from the foregoing description. The apparatus 10 may be constructed of conventional engineering materials used for cable reeling equipment. Thanks to the unique arrangement of the spool 60, supported in a cantilever manner from the end part 33 of the shaft 32, which shaft is adapted for rotation about a generally horizontal central axis 83, FIG. 3, the unique arrangement of the operating levers 42 and 52 and the unique construction of the spool 60 an improved, generally portable cable reeling and dereeling apparatus has been provided.

Although a detailed description of a preferred embodiment of the present invention has been set forth herein, those skilled in the art will recognize that various substitutions and modifications may be made to the specific embodiment described without departing from the scope and spirit of the invention as recited in the appended claims.

What we claim is:

1. Apparatus for reeling a length of flexible cable into a coil, comprising:

a frame including means for supporting a shaft for rotation about a generally central horizontal axis of said shaft;

a shaft mounted on said frame for rotation about said axis;

cable spool means mounted on one end of said shaft for rotation with said shaft for reeling and dereeling flexible cable;

drive means including a propulsion unit and clutch means interposed between said propulsion unit and said shaft for drivingly engaging and disengaging said shaft from said propulsion unit for controlling the rotation of said shaft and said spool means;

clutch lever means supported on said frame for pivotal movement for engaging and disengaging said clutch means;

brake lever means supported on said frame adjacent to said clutch lever means for pivotal movement in a plane substantially parallel to said clutch lever means;

brake means for braking the rotation of said shaft to control the rotation of said spool means, said brake means including a sheave mounted on said shaft for rotation therewith at the end of said shaft opposite said spool means, said sheave including circumferential groove means formed therein and brake shoe means mounted on said brake lever means for engaging a part of said sheave defining said groove means for applying braking forces to said shaft; and an operator platform connected to said frame for supporting an operator of said apparatus adjacent to said spool means and said lever means, respectively, for operating said lever means to control the rotation of said spool means.

* * * * *